United States Patent [19]

Tax

[11] Patent Number: 4,973,947

[45] Date of Patent: Nov. 27, 1990

[54] SELF-CONTAINED PORTABLE FLOOD ALARM

[76] Inventor: Richard F. Tax, 630 Montview Pl., River Vale, N.J. 07675

[21] Appl. No.: 396,299

[22] Filed: Aug. 21, 1989

[51] Int. Cl.[5] ..... G08B 21/00

[52] U.S. Cl. ..... 340/618; 340/608; 340/623; 340/625; 200/61.04

[58] Field of Search ..... 340/618, 608, 623, 625, 340/605, 616, 624; 200/61.04

[56] References Cited

U.S. PATENT DOCUMENTS

| | | | |
|---|---|---|---|
| 3,786,464 | 1/1974 | Staempfli | 340/623 |
| 4,203,097 | 5/1980 | Manning | 340/623 |
| 4,264,902 | 4/1981 | Miller | 340/604 |
| 4,325,060 | 4/1982 | Purtell | 340/605 |
| 4,540,976 | 9/1985 | Wegrzyn | 340/618 |
| 4,644,328 | 2/1987 | Szymansky | 340/623 |

*Primary Examiner*—Joseph A. Orsino
*Assistant Examiner*—Kinfe-Michael Negash
*Attorney, Agent, or Firm*—Samuelson & Jacob

[57] ABSTRACT

A self-contained, portable flood alarm is installed at a prospective flood site by merely placing the flood alarm on a flood-prone surface at the site and activates an alarm signal in response to the occurrence of a flood condition on the flood-prone surface as a result of the flotation of a buoyant element of the flood alarm, the buoyant element being capable of floating the entire flood alarm so that the alarm signal will commence immediately upon the onset of the flood condition and will continue independent of the height of the crest of the flood condition.

3 Claims, 3 Drawing Sheets

SELF-CONTAINED PORTABLE FLOOD ALARM

The present invention relates generally to signalling devices and pertains, more specifically, to a self-contained, portable flood alarm for selective placement at any one of a variety of prospective flood sites to signal the occurrence of a flood condition at the site.

A variety of devices has been made available for warning of the onset of flood conditions at sites prone to flooding. Many of these devices employ sensors including buoyant members which, when raised or otherwise moved by the presence of flood water, operate electrical switches to activate an alarm circuit. Often, the alarm annunciator itself is remote from the flood site and the sensors, requiring relatively extensive installation procedures and construction. In other arrangements, the entire device is located at the flood-prone site and is susceptible to damage and to being put out of commission by excessive flooding.

The present invention provides a portable, self-contained flood alarm which alleviates the above-outlined shortcomings and enables several objects and advantages, some of which are summarized as follows: Provides a free-standing, self-contained, fully-portable unit which requires no installation other than mere placement at a prospective flood site; signals the onset of a flood condition and continues to operate regardless of the depth and severity of flooding; enables a high degree of sensitivity for early warning of the presence of a flood condition; provides exceptional simplicity of construction and operation, enabling economical manufacture and practical widespread use; exhibits flexibility of design and compact construction, enabling exemplary service at a variety of flood-prone sites, including sites heretofore not amenable to the installation of flood warning devices; renders flood alarm technology so simple and economical as to be available readily to the ordinary homeowner at reasonable cost; provides reliable and effective operation throughout a relatively long service life.

The above objects and advantages, as well as further objects and advantages, are attained by the present invention, which may be described briefly as a self-contained, portable flood alarm for selective placement upon a flood-prone surface at a prospective flood site to signal the occurrence of a flood condition at the selected site, the flood alarm comprising: a housing having a base for resting upon the flood-prone surface; an alarm circuit in the housing, the alarm circuit including alarm signal means, a power source for powering the alarm signal means, a circuit between the power source and the alarm signal means, and switch means for opening and closing the circuit between the power source and the signal means; and buoyancy means associated with the housing and movable in response to the occurrence of a flood condition on the flood-prone surface to actuate the switch means so as to complete the circuit between the power source and the signal means to signal the presence of the flood condition and to maintain at least a portion of the housing above the crest of the flood condition so as to assure continued signalling of the presence of the flood condition independent of the height of the crest of the flood condition.

The invention will be understood more fully, while still further objects and advantages will become apparent, in the following detailed description of preferred embodiments of the invention illustrated in the accompanying drawing, in which.

Figure 1:
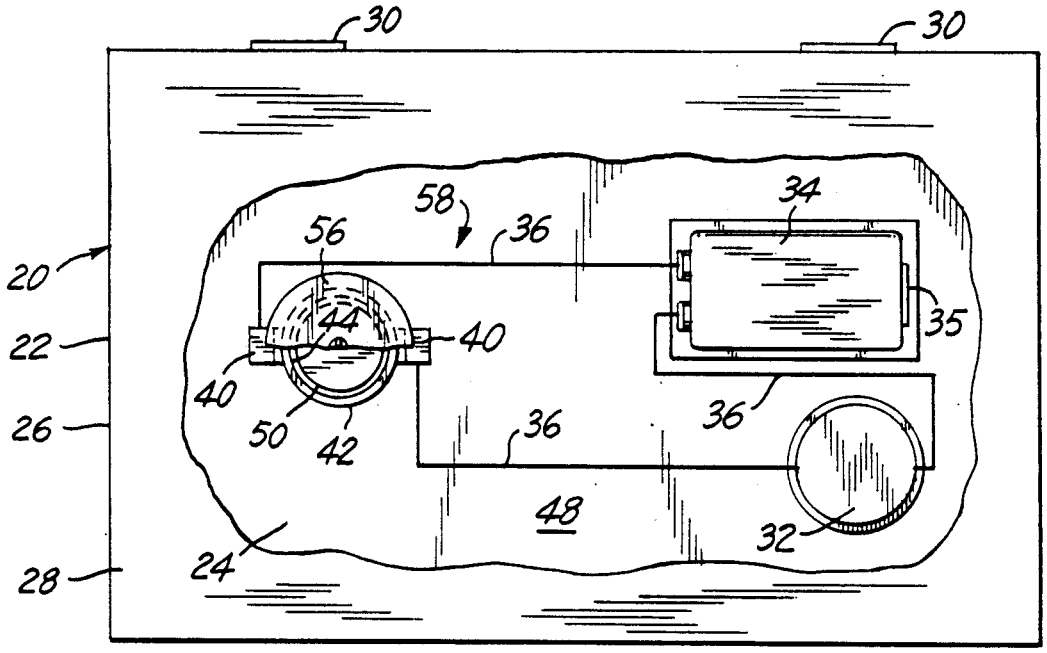
FIG. 1 is a top plan view of a flood alarm constructed in accordance with the present invention, broken away to illustrate internal component parts.
Figure 2:
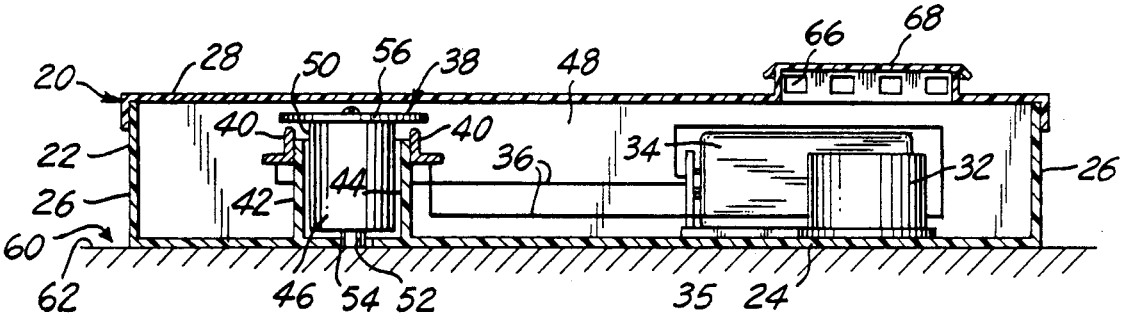
FIG. 2 is an elevational cross-sectional view of the flood alarm.
Figure 3:
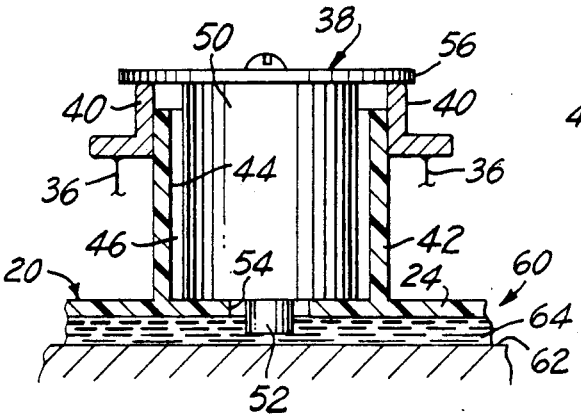
FIG. 3 is an enlarged fragmentary cross-sectional view of a portion of FIG. 2, with component parts in another operating position.

Referring now to the drawing, and especially to FIGS. 1 through 3 thereof, a flood alarm constructed in accordance with the invention is illustrated generally at 20 and is seen to include a housing 22 having a base 24, side walls 26 extending upwardly from the base 24, and a cover 28 hinged to one of the side walls 26 at hinges 30. Located inside the housing 22 is an alarm transducer in the form of an electrically-operated annunciator 32 affixed to the inside of the base 24. A power source in the form of a battery 34 is secured to the base 24 in a battery holder 35 and is connected, by means of electrical conductors 36, through a switch 38 to the annunciator 32.

The switch 38 includes a pair of electrical contacts 40 mounted upon the tubular wall 42 of a chamber 44, the tubular wall 42 extending upwardly from the base 24 so as to at least partially isolate the interior 46 of the chamber 44 from the interior 48 of the housing 22. A weighted cylindrical plunger 50 is loosely fitted in the chamber 44 for movement freely upwardly and downwardly within the chamber 44, and carries a projection 52 which extends through a complementary aperture 54 in the portion of base 24 at the chamber 44. An electrically conductive disk 56 is affixed to the top of the plunger 50 and moves with the plunger 50, between an upper position, as seen in FIG. 2, where the disk 56 is out of contact with the contacts 40, and a lower position, illustrated in FIG. 3, where the disk 56 is in contact with the contacts 40.

Figure 4:
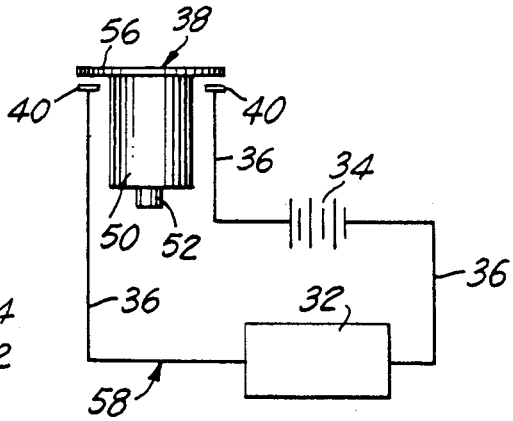
FIG. 4 is a schematic diagram of the alarm circuit of the flood alarm.
Figure 5:
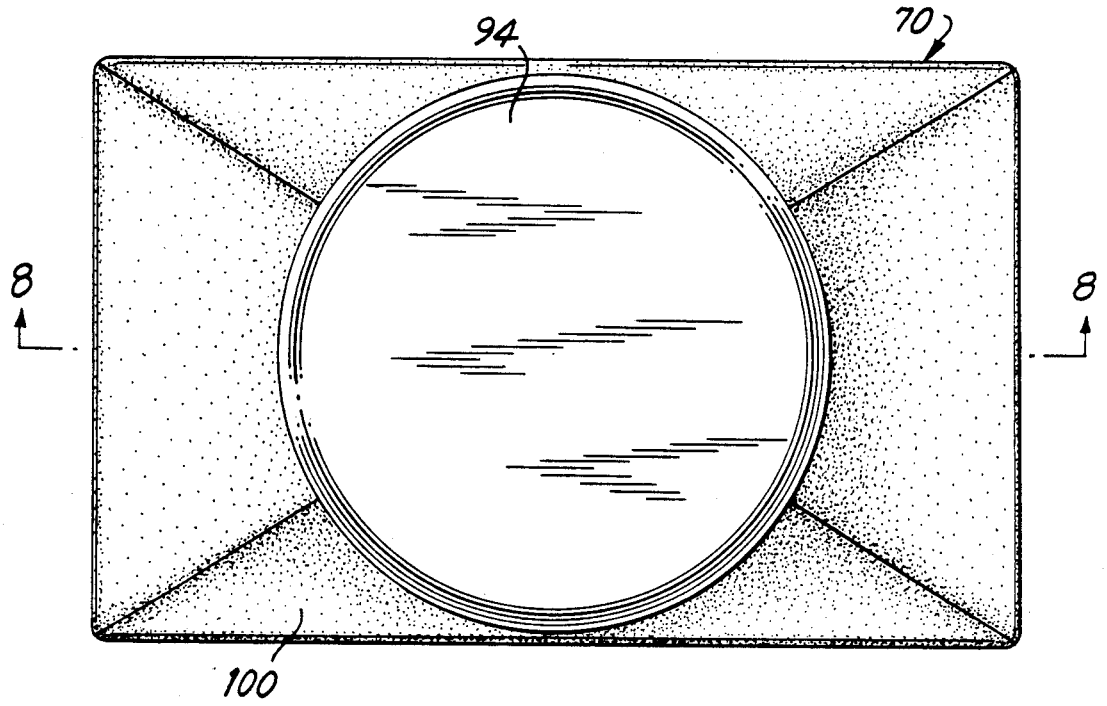
FIG. 5 is a top plan view of another flood alarm constructed in accordance with the invention.
Figure 6:
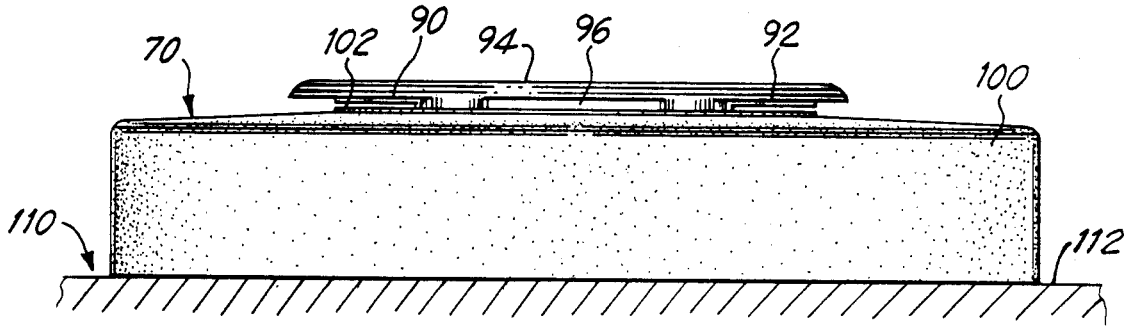
FIG. 6 is a front elevational view of the flood alarm of FIG. 5.
Figure 7:
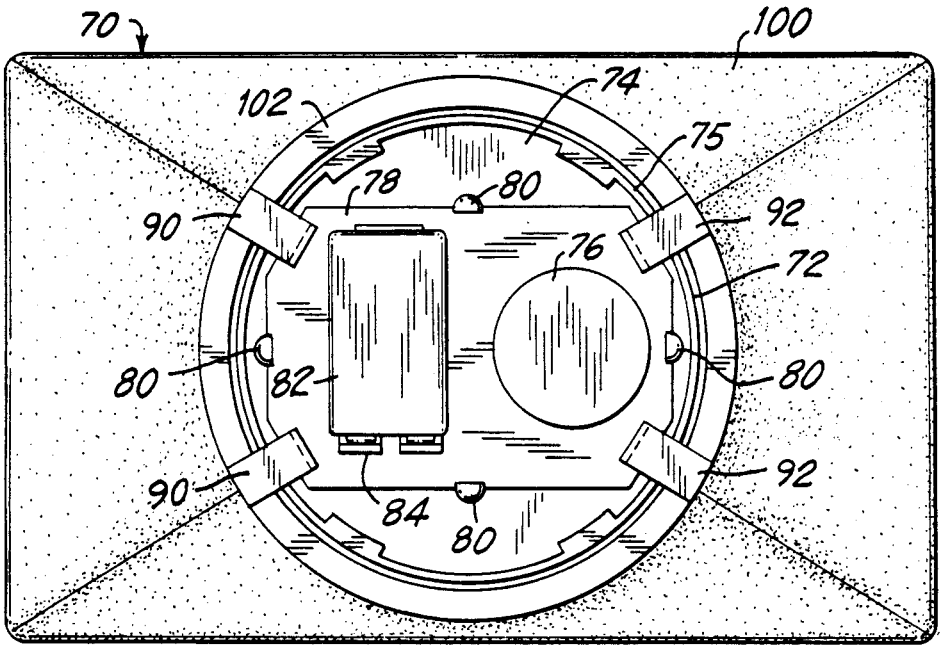
FIG. 7 is top plan view of the flood alarm of FIG. 5, with the cover removed to reveal internal component parts.
Figure 8:
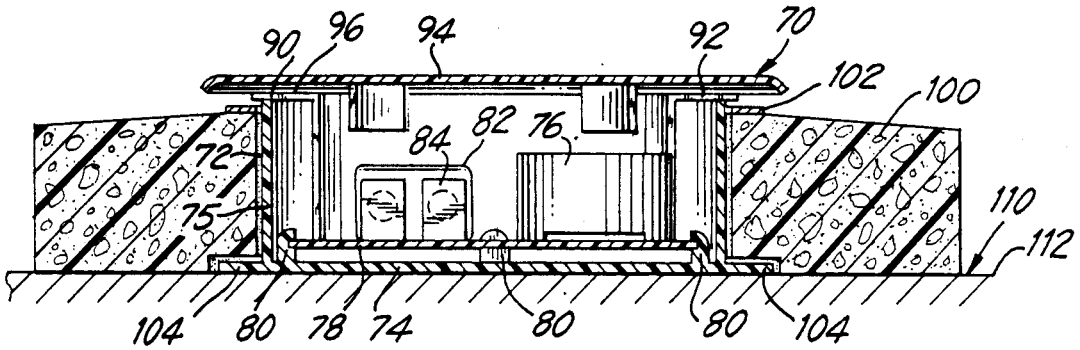
FIG. 8 is cross-sectional view taken along line 8—8 of FIG. 5.

As best seen in FIG. 4, alarm circuit 58 connects the battery 34 with the annunciator 32 through the switch 38 which completes the circuit between the battery 34 and the annunciator 32 when the disk 56 completes the electrical connection between the contacts 40. Returning now to FIGS. 2 and 3, the flood alarm 20 is put into use by merely placing the housing 22 at prospective flood site 60, with the base 24 resting upon a flood-prone surface 62 at the prospective flood site 60. For example, flood-prone surface 62 may be the floor adjacent a washing machine or a hot water heater in the basement of a home. When the base 24 rests upon the flood-prone surface 62, the projection 52 also rests against the flood-prone surface 62 and the plunger 50 is maintained in the upper position illustrated in FIG. 2, with the disk 56 out of contact with contacts 40 so that the alarm circuit 58 is open. Upon the occurrence of a flood condition, as illustrated by the presence of flood water 64 in FIG. 3, the housing 22 will float upon the flood water 64, thereby raising the housing 22 at the onset of the flood condition and permitting the weighted plunger 50 to drop, in response to the biasing force of gravity, to the lower position illustrated in FIG. 3, in which lower position the disk 56 is lowered into contact with contacts 40 to complete the circuit 58 and sound the alarm provided by annunciator 32.

Thus, the housing 22 serves as a buoyant means in the form of a hull-like member which floats upon the flood water 64 to complete the alarm circuit 58 and activate the alarm signal. To this end, housing 22 preferably is constructed of a lighter weight, water-tight material, such as a synthetic resin material, and is buoyant enough to be raised in the presence of even a small volume of flood water 64 so as to provide an early warning of the onset of the flood condition. Since the housing 22 floats on the flood water 64, the alarm provided by annunciator 32 will continue to sound as long as the flood water 64 is present, independent of the height of the crest of the flood water 64. Hence, the flood alarm 20 is more-or-less immune to the severity of the flood condition and will continue to function even in the highest and deepest of flood waters. It is noted that the interior 48 of the housing 22 is isolated from the flood water 64 and remains relatively dry so that the circuit 58 remains unaffected. Thus, the small amount of flood water which may enter the interior 46 of the chamber 44 through aperture 54 is isolated from the interior 48 by the tubular wall 42, while freedom of movement of the plunger 50 remains unimpaired. The cover 28 includes an opening 66 immediately above the annunciator 32 so as not to impede the sound of the annunciator 32, and a splash deflector 68 is placed over the opening 66 to prevent any splashed or sprayed flood water from entering the interior 48 through the opening 66. Although the alarm transducer is illustrated in the form of annunciator 32, it will be apparent that the alarm transducer may be a transmitter or a like device which provides a signal other than an audible alarm for detection at a remote location.

Turning now to FIGS. 5 through 8, another embodiment of the invention is illustrated in the form of flood alarm 70 having a housing 72 with a generally circular base 74 and a cylindrical side wall 75 extending upwardly from the base 74. Located inside the housing 72 is an alarm transducer in the form of an electrically-operated annunciator 76 affixed to a circuit board 78 which itself is secured to the base 74 of the housing 72 by means of upstanding tabs 80. A battery 82 is held in a battery holder 84 attached to the circuit board 78 and an electrical circuit in the circuit board 78 connects the battery 82 to the annunciator 76 through a switch means which includes two pairs of electrical contacts 90 and 92 placed adjacent the top of the cylindrical side wall 75 of the housing 72 and a conductor ring 102. A splash cover 94 closes the housing 72 against water which may be sprayed over or splashed against the housing 72, but maintains an opening 96 for the passage of sound from the annunciator 76.

A float 100 of low-density buoyant material surrounds the housing 72 and carries the ring 102 of electrically-conductive material placed immediately below the contacts 90 and 92. A lower flange 104 on the housing 72 retains the float 100 in place around the housing 72; however, the float 100 is free to move upwardly and downwardly through a small displacement so that the ring 102 normally is out of contact with the contacts 90 and 92 when the float 100 rests against the flange 104, but can move upwardly until the ring 102 is brought into contact with the contacts 90 and 92.

Figure 9:
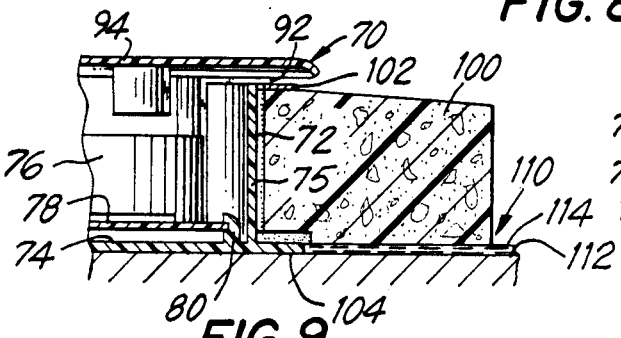
FIG. 9 is a fragmentary cross-sectional view of a portion of FIG. 8 showing component parts in another operating position.
Figure 10:
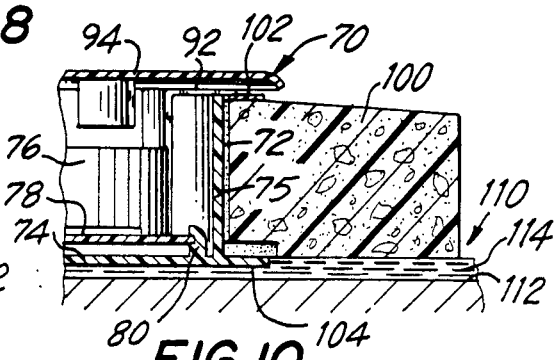
FIG. 10 is a fragmentary cross-sectional view similar to FIG. 9 and illustrating another operating condition.

As in the earlier-described embodiment of FIGS. 1 through 4, flood alarm 70 is installed at a prospective flood site 110 merely by placing the housing 72 upon a flood-prone surface 112 at the flood site 110. Should a flood condition occur, as seen in FIG. 9, float 100 will float on the flood water 114 and will rise until ring 102 comes into contact with at least one of the pairs of contacts 90 or 92, thereby completing the circuit in the circuit board 78 and activating the annunciator 76 to sound an alarm. Should the flood water 114 continue to rise, the float 100 will be coupled mechanically, as well as electrically, with the contacts 90 and 92 so that the housing 72 will rise with the rising flood water 114 and the entire flood alarm 70 will float on the flood water 114, as illustrated in FIG. 10, thereby continuing to sound an alarm, independent of the height of the crest of the flood water 114, until the flood water 114 subsides. As before, the ability of the flood alarm to float upon the flood water 114 renders the flood alarm 70 essentially immune to the severity of the flood condition. It is noted that the float 100 possesses sufficient buoyancy to raise the housing 72, and the contacts 90 and 92 are constructed with sufficient mechanical strength to withstand the forces necessary to float the housing 72 as a result of the coupling of the float 100 with the housing 72 through the contacts 90 and 92.

It will be seen that the flood alarm of the present invention provides a free-standing, self-contained, fully-portable unit which requires no installation other than mere placement at a prospective flood site; signals the onset of a flood condition and continues to operate regardless of the depth and severity of flooding; enables a high degree of sensitivity for early warning of the presence of a flood condition; provides exceptional simplicity of construction and operation, enabling economical manufacture and practical widespread use; exhibits flexibility of design and compact construction, enabling exemplary service at a variety of flood-prone sites, including sites heretofore not amenable to the installation of flood warning devices; renders flood alarm technology so simple and economical as to be available readily to the ordinary homeowner at reasonable cost; and provides reliable and effective operation throughout a relatively long service life.

It is to be understood that the above detailed description of preferred embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. A self-contained, portable flood alarm for placement upon a floor-prone surface at a selected prospective flood site to signal the occurrence of a flood condition at the selected prospective flood site, the flood condition having an onset and a subsequent crest located at a height above the flood-prone surface, the flood alarm comprising:

a housing having a base for resting upon the flood-prone surface, when the flood alarm is placed at the selected prospective flood site;

an alarm circuit in the housing, the alarm circuit including alarm signal means, a power source for powering the alarm signal means, a circuit between the power source and the alarm signal means, and switch means responsive to the occurrence of a flood condition for completing the circuit between the power source and the signal means to signal the onset of the flood condition;

buoyancy means for effecting movement of the housing in response to a flood condition on the flood-prone surface to maintain at least a portion of the housing above the crest of the flood condition so as to assure continued signalling of the presence of the flood condition beyond the onset of the flood condition, independent of the height of the crest of the flood condition;

the switch means including freely movable contact means associated with the buoyancy means such that the contact means maintains the circuit between the power source and the alarm signal means open in the absence of a flood condition on the flood-prone surface and the buoyancy means moves the contact means at the onset of the flood condition to complete the circuit between the power source and the alarm signal means immediately after the onset of the flood condition;

the buoyancy means including a buoyant member movable relative to the base of the housing in response to the onset of the flood condition, and the switch means being actuated between an open condition and a closed condition in response to movement of the buoyant member, the buoyant member being movable upwardly from a first position wherein the buoyant member rests at the flood-prone surface and the switch means is in the open condition, to a second position wherein the buoyant member is raised above the flood-prone surface and the switch means is in the closed condition, while the base of the housing remains at rest upon the flood-prone surface; and coupling means for coupling the buoyant member with the housing upon continued upward movement of the buoyant member, the buoyant member being sufficiently buoyant to raise the housing and the base thereof, when the buoyant member is coupled with the housing, away from the flood-prone surface with the rising height of the crest of the flood condition.

2. The invention of claim 1 wherein the alarm signal means includes an annunciator for sounding an alarm.

3. The invention of claim 1 wherein the power source includes a battery.

* * * * *